US008414466B2

(12) United States Patent
Hashimoto

(10) Patent No.: US 8,414,466 B2
(45) Date of Patent: Apr. 9, 2013

(54) CENTRIFUGE ROTOR COVER

(75) Inventor: Toshiharu Hashimoto, Gunma (JP)

(73) Assignee: Kubota Manufacturing Corporation, Tokyo (JP)

( * ) Notice: Subject to any disclaimer, the term of this patent is extended or adjusted under 35 U.S.C. 154(b) by 0 days.

(21) Appl. No.: 13/256,428

(22) PCT Filed: Apr. 8, 2010

(86) PCT No.: PCT/JP2010/056381

§ 371 (c)(1),
(2), (4) Date: Sep. 13, 2011

(87) PCT Pub. No.: WO2011/001730

PCT Pub. Date: Jan. 6, 2011

(65) Prior Publication Data

US 2012/0004089 A1 Jan. 5, 2012

(30) Foreign Application Priority Data

Jun. 30, 2009 (JP) ..... 2009-155611

(51) Int. Cl.
*B04B 7/06* (2006.01)

(52) U.S. Cl. ..... 494/12; 494/16

(58) Field of Classification Search ..... 494/12, 494/16, 20, 33, 38, 64, 84, 85; 210/232
See application file for complete search history.

(56) References Cited

U.S. PATENT DOCUMENTS

| | | | | |
|---|---|---|---|---|
| 3,819,111 | A * | 6/1974 | Romanauskas et al. | 494/16 |
| 4,360,151 | A * | 11/1982 | Cowell et al. | 494/10 |
| 4,753,631 | A * | 6/1988 | Romanauskas | 494/9 |
| 6,063,018 | A | 5/2000 | Letourneur | |
| 2004/0220037 | A1 | 11/2004 | Potter | |
| 2004/0224831 | A1 | 11/2004 | Potter | |
| 2011/0212819 | A1 * | 9/2011 | Kohn et al. | 494/10 |
| 2012/0004089 | A1 * | 1/2012 | Hashimoto | 494/60 |

FOREIGN PATENT DOCUMENTS

| | | |
|---|---|---|
| JP | S36-005594 | 5/1961 |
| JP | S52-114369 | 8/1977 |
| JP | H07-021137 | 4/1995 |
| JP | 2002-086017 | 3/2002 |
| JP | 2002086017 A * | 3/2002 |
| JP | 2005-526604 | 9/2005 |
| JP | 2006-130485 | 5/2006 |
| JP | 2008-307495 | 12/2008 |
| WO | WO 2007/134624 | 11/2007 |

OTHER PUBLICATIONS

Office action issued Nov. 5, 2012 for corresponding Chinese patent application No. 201080017431.9.

* cited by examiner

*Primary Examiner* — Charles E Cooley
(74) *Attorney, Agent, or Firm* — David N. Lathrop

(57) ABSTRACT

A centrifuge rotor cover has a lid, a circular plate attached to the lid with click holes formed in a circle, a knob and knob shaft, a plate spring attached to a surface of the knob facing the circular plate and an elastic body pushing the lid against the rotor depending on the distance between the knob and the lid. If this distance is equal to or less than a predetermined value, the plate spring is caught repeatably in the click holes as the knob is turned to cause sounds and vibrations that indicate the knob is not tightened securely.

10 Claims, 4 Drawing Sheets

CENTRIFUGE ROTOR COVER

TECHNICAL FIELD

The present invention relates to a lid-section mechanism for rotors that covers the upper surface of the rotor of a centrifuge comprising a rotating shaft, a rotating head secured to one end of the rotating shaft, and a rotor attached to the rotating head.

BACKGROUND ART

The method of securing the rotor and lid of a centrifuge to the rotating head proposed in patent literature 1 is known as a prior-art method. The centrifuge shown in patent literature 1 comprises a rotating shaft, a rotating head secured to one end of the rotating shaft, a rotor attached to the rotating head, and a lid covering the upper surface of the rotor. The knob shaft is secured to the knob. When the knob is turned to secure the knob shaft to the rotating head, the rotor as well as the lid is secured to the rotating head. Since tightening the lid also secures the rotor, both the lid and the rotor can be easily secured.

PRIOR ART LITERATURE

Patent Literature

Patent literature 1: Japanese Patent Application Laid Open No. 2002-86017

SUMMARY OF THE INVENTION

Problems to be Solved by the Invention

Even in the technique proposed in patent literature 1, if the lid is not properly placed or the knob is loosely tightened, the lid or rotor may be removed. An object of the present invention is to prevent the tightened lid from being loosened.

Means to Solve the Problems

A centrifuge related to the present invention comprises a rotating shaft, a rotating head secured to one end of the rotating shaft, a rotor attached to the rotating head, and a lid. The rotor has a sample insertion section into which a sample is inserted and the lid covers the surface of the rotor that leads to the sample insertion section. A lid-section mechanism for rotors according to the present invention comprises a lid, a knob, a knob shaft, a circular plate, a plate spring, and an elastic body. The knob is turned to attach or detach the lid. The knob shaft is a cylindrical component that is secured to the knob so as to have the same center as the knob. The knob shaft extends through the lid and has a thread part at its tip. The circular plate is attached to the surface of the lid that faces the knob and has a plurality of click holes formed on a circle centered at the shaft center of the rotating shaft and has a shaft hole through which the knob shaft extends. The plate spring is attached to the surface of the knob that faces the circular plate and, if the distance between the knob and the lid is equal to or less than a predetermined value, a part of the plate spring is caught in the click hole. The elastic body is placed between the knob and the lid and pushes the lid against the rotor depending on the distance between the knob and the lid. Turning the knob when the distance between the knob and the lid is equal to or less than the predetermined value repeats a cycle in which the plate spring is caught in the click hole and then the plate spring is bent and removed from the click hole.

Effects of the Invention

In a lid-section mechanism for rotors according to the present invention, turning the knob when the distance between the knob and the lid is equal to or less than a predetermined value repeats a cycle in which the plate spring is caught in the click hole and then the plate spring is bent and removed from the click hole. At this time, the plate spring causes sounds and vibrations. These sounds and vibrations are surely recognized by the user because, for example, the circular plate or lid functions as a resonance body. Accordingly, it is possible to check whether the knob is tightened securely regardless of the differences among users.

DETAILED DESCRIPTION OF THE EMBODIMENTS

Figure 1:
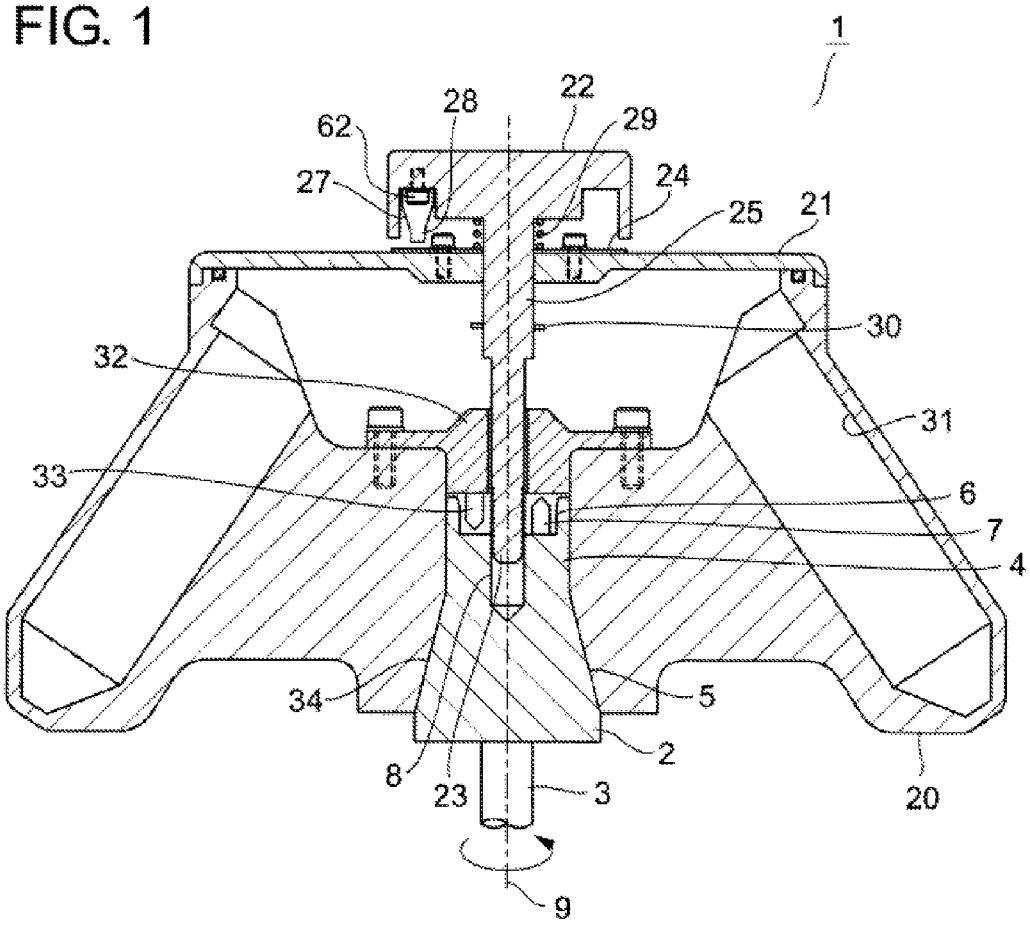
FIG. 1 is a sectional view showing the internal structure of a centrifuge according to a first embodiment.

Embodiments of the present invention will be described in detail below. Components with the same functions are denoted by the same reference numerals to omit duplicate descriptions.

First Embodiment

Consideration of the Reason

First, the reason why the lid or rotor is removed is studied. This problem is assumed to be caused by the differences among individuals who tighten the lid of a centrifuge. More specifically, the lid of a centrifuge is tightened by end users. End users may have strong power or have weak power, may be familiar with the use of a centrifuge or not be familiar with the use, and may know the risk of a centrifuge or not know the risk. Accordingly, the degree to which the lid is sufficiently tightened depends on the differences among individuals. Some end users who are not familiar with the use of a centrifuge may turn the knob even though the knob shaft is inappropriately inserted into the rotating head. In such a case, threads engage incorrectly each other and the lid is not tightened sufficiently even if the knob is turned strongly. As described above, tightening of the lid varies among individuals. Accordingly, the present invention eliminates the differences in the tightening of the lid of a centrifuge among individuals to prevent the tightened lid from being loosened.

Structure

Figure 2:
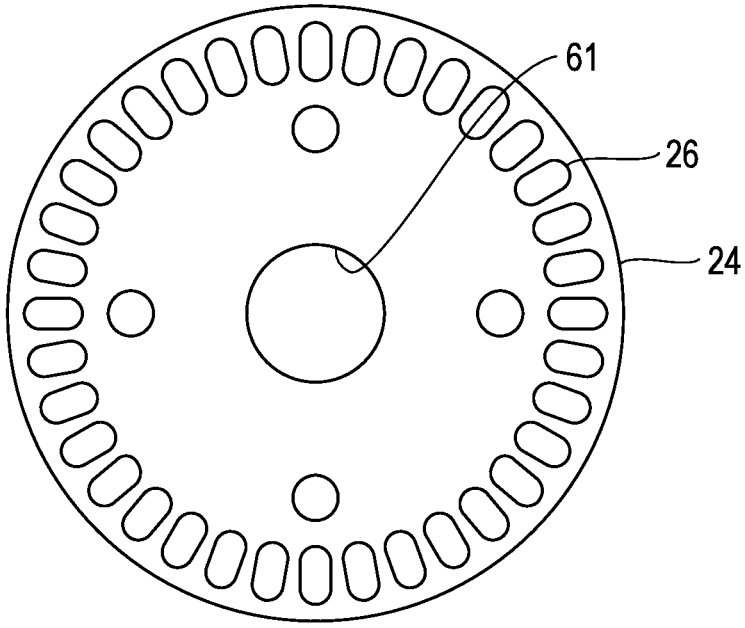
FIG. 2 is a plan view showing a circular plate.
Figure 3:
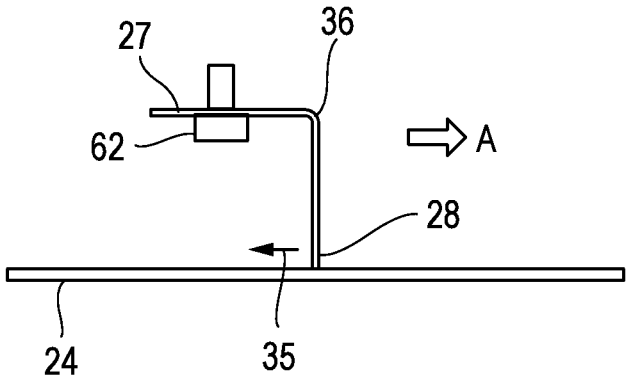
FIG. 3 shows the relationship between the circular plate and a plate spring.

FIG. 1 is a sectional view showing the internal structure of a centrifuge according to a first embodiment. FIG. 2 is a plan view showing a circular plate. FIG. 3 shows the relationship between the circular plate and a plate spring. FIG. 1 shows a rotating shaft 3 with a shaft center 9 extending in the vertical direction, a rotating head 2 placed on the rotating shaft 3, a rotor 20 placed on the rotating head 2, a lid 21 covering an upper section of the rotor 20, a knob 22, a knob shaft 25, a circular plate 24, a plate spring 27, an elastic body 29, etc. A lid-section mechanism for rotors according to the present invention comprises at least the lid 21, the knob 22, the knob shaft 25, the circular plate 24, the plate spring 27, and the elastic body 29. Although not shown in the drawing, a centrifuge 1 also comprises a motor for rotating the rotating shaft 3 and a body for enclosing the entire system.

The upper part of the rotor 20 has a plurality of sample insertion sections 31, which store samples. The lid 21 covers the surface of the rotor 20 that leads to the sample insertion sections 31. The rotor 20 also comprises a rotor hole 34 into which the rotating head 2 is inserted, a frame 32, and guide pins 33. The rotor hole 34 is a circular hole that is tapered toward a predetermined depth and has the same diameter in the remaining part. The frame 32 has a hole through which the knob shaft 25 extends.

The rotating head 2 has a rotor connection part 6 and drive pins 7 thereon. The rotor connection part 6 is cylindrical about the shaft center 9 of the rotating shaft. Below the rotor connection part 6, the rotating head 2 also has a cylindrical section 4, which is a circular section of a constant diameter and fits into the rotor hole 34, and a truncated cone section 5, which has a larger diameter in a lower position. In addition, a thread section 8 is formed at the shaft center 9 of the cylinder section 4.

The knob 22 is turned to attach or detach the lid 21. The knob shaft 25 is a cylindrical component secured to or formed integrally with the knob 22 so as to have the same center as the knob 22. The knob shaft 25 extends through the lid 21 and has a thread part 23 at its tip. If the knob 22 is turned when the knob shaft 25 is centered at the shaft center 9 of the rotating shaft 3, the thread part 23 screws into the thread section 8 of the rotating head 2. The circular plate 24 is placed on the surface of the lid 21 that faces the knob 22. The circular plate 24 has a plurality of click holes 26, which are formed on a circle centered at the shaft center 9 of the rotating shaft 3 and a shaft hole 61 through which the knob shaft extends. The knob shaft 25 may be secured by a snap ring 30 or the like.

The plate spring 27 is secured by a screw 62 to the surface of the knob 22 that faces the circular plate 24. An end 28 of the plate spring 27 is caught in the click hole 26 when the distance between the knob 22 and the lid 21 is equal to or less than a predetermined value. An elastic body 29 is placed between the knob 22 and the lid 21 (or the circular plate 24) and pushes the lid 21 against the rotor 20 depending on the distance between the knob 22 and the lid 21. The predetermined value determines the length of the elastic body 29; it is desirable to determine the predetermined value and the natural length and elastic coefficient of the elastic body 29 so that a force pushing the lid 21 becomes sufficient when the distance is equal to or less than the predetermined value.

Since the guide pins 33 secured to the frame 32 can move only between the drive pins 7, power is transferred from drive pins 7 to the guide pins 33 when the rotating head 2 turns, and the rotor 20 rotates. Since the drive pins 7 restrict the movement of the guide pins 33 also when the rotating head 2 stops, the rotor 20 stops together with the rotating head 2.

Next, the procedure for tightening the lid 21 will be described below. The lid 21 and the knob 22 are placed on the rotor 20 in an attitude in which the thread part 23 of the knob shaft 25 can screw into the thread section 8 of the rotating head 2. Then, the knob 22 is turned so that the thread part 23 screws into the thread section 8 of the rotating head 2. When the distance between the knob 22 and the lid 21 is equal to the predetermined value, the end 28 of the plate spring 27 begins to engage the click hole 26 of the circular plate 24. When the knob 22 is further turned, the cycle in which the end 28 of the plate spring 27 is caught in the click hole 26 and then the plate spring 27 is bent and removed from the click hole 26 is repeated. At this time, the plate spring causes sounds and vibrations. Arrow A in FIG. 3 indicates the direction in which the knob 22 is turned during tightening and arrow 35 indicates the direction in which the plate spring 27 is bent. The plate spring 27 is bent with a point 36 used as the fulcrum. The sounds and vibrations caused by the plate spring 27 are surely recognized by the user because, for example, the circular plate or lid functions as a resonance body.

The following will describe the reason why the present invention can check whether the lid is sufficiently tightened regardless of the differences among users. In the lid-section mechanism for rotors according to the present invention, sounds and vibrations are not caused when the force required to turn the knob 22 becomes large, but caused when the distance between the knob 22 and the lid 21 is equal to the predetermined value. As described above, users not familiar with the use of a centrifuge may turn the knob 22 even though the knob shaft 25 is inappropriately inserted into the rotating head. In this case, since the thread section 8 of the knob shaft 25 is not normally inserted into the thread section 8 of the rotating head 2, abnormal engagement with the thread sections 8 is caused. Accordingly, even when the distance between the knob 22 and the lid 21 larger than the predetermined value, the force required to turn the knob 22 becomes large. That is, even if the force required to turn the knob 22 is detected, it is not possible to determine whether the lid 21 is sufficiently pushed against the rotor 20. Therefore, an object of the present invention cannot be achieved by the mechanism for notifying the user of tightening with the required force through vibrations or sounds when the predetermined force is exceeded and the freewheeling occurs, which is adopted by a torque wrench or the lid of an automobile filler cap. On the other hand, in the case of a centrifuge, since the sample does not stick out of the rotor 20, the relative position between the lid 21 and the rotor 20 is constant. Accordingly, the differences in tightening among individuals can be eliminated by using the distance between the knob 22 and the lid 21 to determine whether tightening is sufficient. As described above, since the lid-section mechanism for rotors according to the present invention can determine whether the distance between the knob 22 and the lid 21 is equal to the predetermined value, the user can check whether the tightening by the knob is sufficient regardless of the differences among users.

First Modification

Figure 4A:
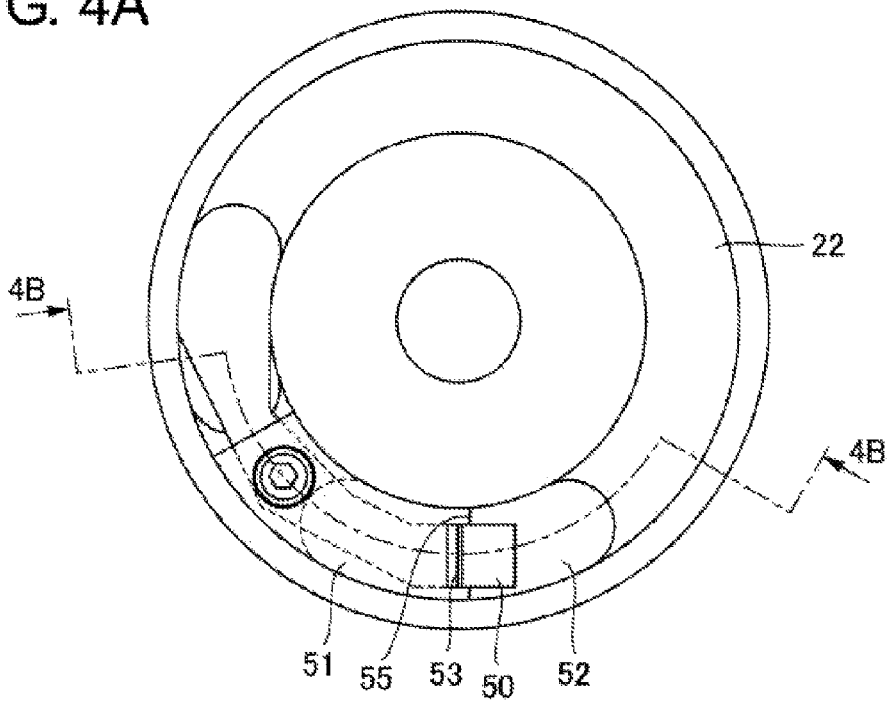
FIG. 4A shows the structure of a knob and the plate spring of a first modification, seen from below the knob.
Figure 4B:
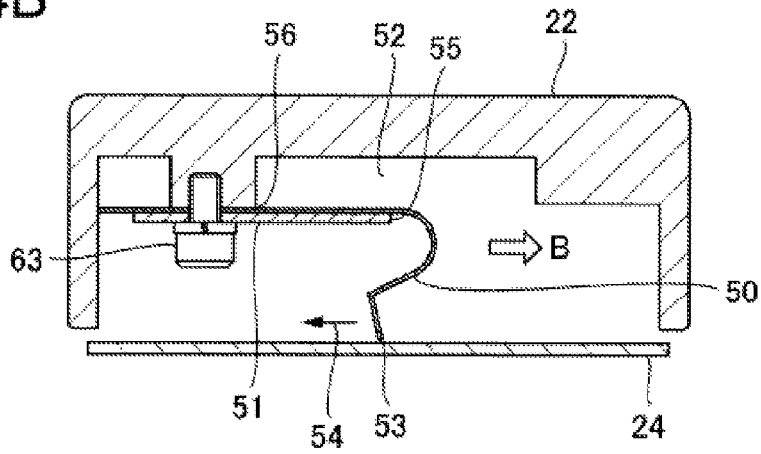
FIG. 4B is a sectional view taken along line 4B-4B in FIG. 4A.

In a first modification, the life of the plate spring is prolonged by changing the shape and the securing method of the plate spring. FIGS. 4A and 4B show the structure of the knob and plate spring of this modification. FIG. 4A shows the structure of the knob seen from below (the knob shaft 25 is not shown); FIG. 4B is a sectional view taken along line 4B-4B in FIG. 4A. A plate spring 50 has a bowed section and is secured by a screw 63 to the surface of the knob 22 that faces the circular plate 24. When the distance between the knob 22 and the lid 21 is equal to or less than the predetermined value, an end 53 of the plate spring 50 is caught in the click hole 26. A reinforcing plate 51 is placed beneath the plate spring 50 and space 52 is formed above the plate spring 50.

The knob 22 is turned in the tightening direction (the direction of arrow B) and, when the distance between the knob 22 and the lid 21 is equal to the predetermined value, the end 53 of the plate spring 50 begins to engage the click hole 26 of the circular plate 24 and the plate spring 50 is bent in the direction of arrow 54 with the point 55 used as the fulcrum. When the knob 22 is further turned, the cycle in which the end 53 of the plate spring 50 is caught in the click hole 26 and then the plate spring 50 is bent and removed from the click hole 26 is repeated.

When the knob 22 is turned in the loosening direction (the direction opposite to arrow B) in the state in which the distance between the knob 22 and the lid 21 is equal to or less than the predetermined value, the plate spring 50 is bent in the direction opposite to arrow 54. At this time, a point 56 is used as the fulcrum. Since the distance between the point 56 and the end 53 is larger than the distance between the point 55 and the end 53, a stress applied to the plate spring 50 becomes smaller. In addition, since the position of the fulcrum in the tightening direction differs from the position of the fulcrum in the loosening direction, the section to which a stress is applied changes between these directions. Accordingly, the life of the plate spring 50 becomes longer than that of the plate spring 27 in consideration of their structures. In addition, since the plate spring 50 has a bowed section, bending can be distributed. This also prolongs the life.

Accordingly, as in the first embodiment, the user can check whether the tightening by the knob is sufficient through sounds and vibrations. In addition, it is also possible to prolong the life of the plate spring and thereby keep the reliability of the centrifuge for a long period of time.

Second Modification

In the first embodiment and the first modification, the knob shaft 25 is tightened and secured to the rotating head 2. In a second modification, a knob shaft 25' is tightened and secured to the rotor 20. The rotor 20 is tightened and secured to the rotating head 2.

Figure 5:
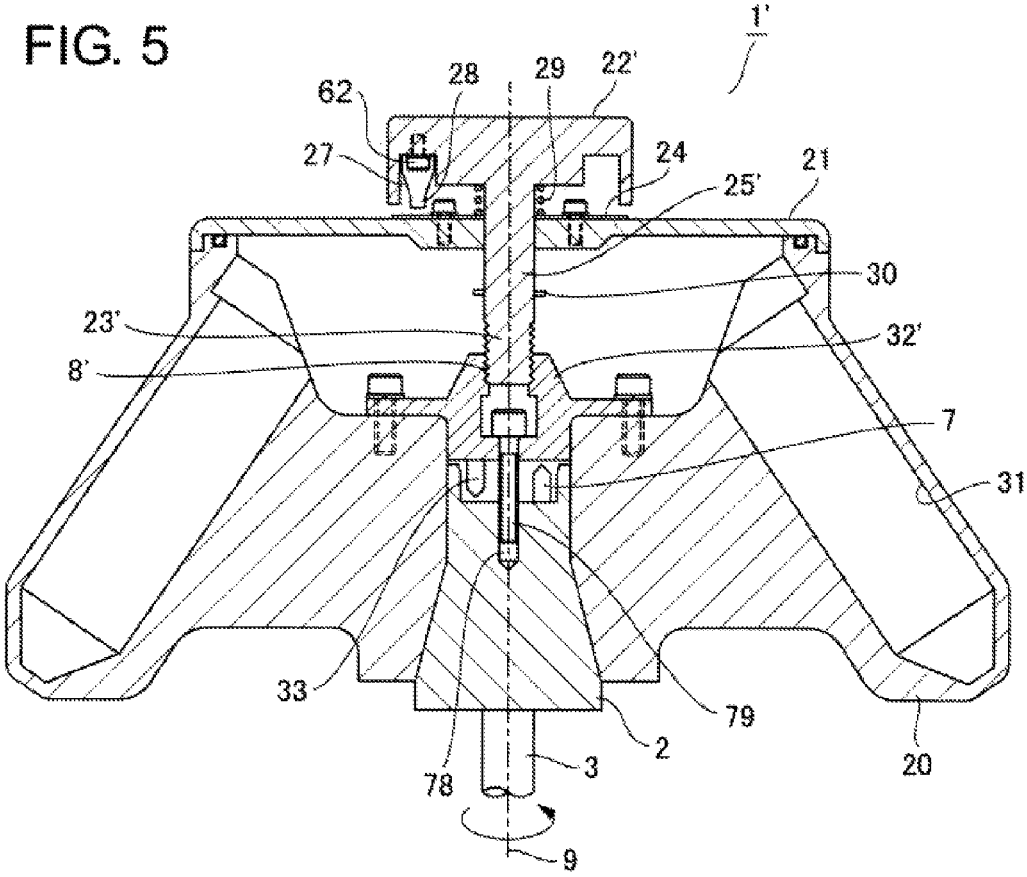
FIG. 5 is a sectional view showing the internal structure of a centrifuge of a second modification.

FIG. 5 is a sectional view showing the internal structure of a centrifuge of the second modification. The differences with the structure in FIG. 1 will be described below. A screw 79 is tightened and engaged with a thread section 78 formed in the rotating head 2 and a frame 32' is pushed against the rotating head 2 to secure the rotor 20. Then, a thread part 23' of the knob shaft 25' is tightened and engaged with a thread section 8' formed in the rotor 20 and the lid 21 is thereby secured to the rotor 20. The remaining part of the structure is the same as in the first embodiment (FIG. 1).

The lid and the rotor as shown in the second modification cannot be secured at the same time differently from the patent literature 1. In the second modification, however, the lid can be secured regardless of the differences among users. Accordingly, the second modification is effective if it is combined with another method of simply securing the rotor to the rotating head.

DESCRIPTION OF REFERENCE NUMERALS

| | | | |
|---|---|---|---|
| 1 | Centrifuge | 2 | Rotating head |
| 3 | Rotating shaft | 4 | Cylindrical section |
| 5 | Truncated cone section | 6 | Rotor connection part |
| 7 | Drive pin | 8, 78 | Thread section |
| 9 | Shaft center | 20 | Rotor |
| 21 | Lid | 22 | Knob |
| 23 | Thread part | 24 | Circular plate |
| 25 | Knob shaft | 26 | Click hole |
| 27 | Plate spring | 28 | End |
| 29 | Elastic body | 30 | Snap ring |
| 31 | Sample insertion section | 32 | Frame |
| 33 | Guide pin | 34 | Rotor hole |
| 50 | Plate spring | 51 | Reinforcing plate |
| 52 | Space | 53 | End |
| 61 | Shaft hole | 62, 63, 79 | Screw |

What is claimed is:

1. A lid-section mechanism for rotors that covers a surface of a rotor of a centrifuge, the surface leading to a sample insertion section, the centrifuge comprising a rotating shaft, a rotating head secured to one end of the rotating shaft, and the rotor that has the sample insertion section storing a sample and is attached to the rotating head, the lid-section mechanism for rotors comprising:

a lid covering the surface of the rotor that leads to the sample insertion section;

a knob turned to attach or detach the lid;

a knob shaft that is a cylindrical component secured to or formed integrally with the knob so as to have the same center as the knob, the knob shaft extending through the lid and having a thread part at a tip thereof;

a circular plate that is placed on the surface of the lid facing the knob, the circular plate having a plurality of click holes formed on a circle centered at the shaft center of the rotating shaft and having a shaft hole through which the knob shaft extends;

a plate spring that is attached to a surface of the knob facing the circular plate and, if the distance between the knob and the lid is equal to or less than a predetermined value, is caught in one of the plurality the click holes; and an elastic body that is placed between the knob and the lid and pushes the lid depending on the distance between the knob and the lid;

wherein turning the knob when the distance between the knob and the lid is equal to or less than the predetermined value repeats a cycle in which the plate spring is caught in the one of the plurality of click holes and then the plate spring is bent and removed from the one of the plurality of click holes.

2. The lid-section mechanism for rotors according to claim 1, wherein the position of a fulcrum in bending the plate spring when the knob is turned in a fix direction differs from the position of a fulcrum in bending the plate spring when the knob is turned in a release direction, and the position of the fulcrum in bending the plate spring when the knob is turned in the fix direction is closer to a part of the plate spring that is caught in the one of the plurality of click holes.

3. The lid-section mechanism for rotors according to claim 2, wherein the plate spring has a bowed section.

4. The lid-section mechanism for rotors according to claim 3, wherein a thread part of the knob shaft is screwed to the rotor.

5. The lid-section mechanism for rotors according to claim 3, wherein a thread part of the knob shaft is screwed to the rotating head.

6. The lid-section mechanism for rotors according to claim 1, wherein the plate spring has a bowed section.

7. The lid-section mechanism for rotors according to claim 6, wherein a thread part of the knob shaft is screwed to the rotor.

8. The lid-section mechanism for rotors according to claim 6, wherein a thread part of the knob shaft is screwed to the rotating head.

9. The lid-section mechanism for rotors according to claim 1, wherein a thread part of the knob shaft is screwed to the rotor.

10. The lid-section mechanism for rotors according to claim 1, wherein a thread part of the knob shaft is screwed to the rotating head.

* * * * *